US008186367B1

(12) United States Patent
Le tran et al.

(10) Patent No.: US 8,186,367 B1
(45) Date of Patent: May 29, 2012

(54) FOLDABLE WALKER

(75) Inventors: Tuan Le tran, St. Petersburg, FL (US); Sukru Gokcek, Tampa, FL (US)

(73) Assignee: University of South Florida, Tampa, FL (US)

( * ) Notice: Subject to any disclaimer, the term of this patent is extended or adjusted under 35 U.S.C. 154(b) by 99 days.

(21) Appl. No.: 12/836,981

(22) Filed: Jul. 15, 2010

Related U.S. Application Data

(60) Provisional application No. 61/227,246, filed on Jul. 21, 2009.

(51) Int. Cl.
*A61H 3/00* (2006.01)

(52) U.S. Cl. ..... 135/67; 135/74; 135/76; 482/66; 248/166

(58) Field of Classification Search ..... 135/65, 135/67, 84, 145, 74–76; 482/66–68; 297/42, 297/46, 106, 16.1, 16.2; 211/195, 202; 248/166, 248/277.1
See application file for complete search history.

(56) References Cited

U.S. PATENT DOCUMENTS

| | | | | |
|---|---|---|---|---|
| 398,943 | A * | 3/1889 | Crandall | 297/45 |
| 2,734,554 | A * | 2/1956 | Ries | 482/66 |
| 3,658,079 | A | 4/1972 | Block | |
| 3,945,389 | A | 3/1976 | Smith | |
| 3,993,088 | A | 11/1976 | Thomas | |
| 4,046,374 | A * | 9/1977 | Breyley | 482/68 |
| 4,251,044 | A * | 2/1981 | Olson | 248/166 |
| 4,729,395 | A * | 3/1988 | Adamson | 135/67 |
| 4,907,794 | A | 3/1990 | Rose | |
| 5,172,715 | A | 12/1992 | Webb | |
| 5,188,139 | A | 2/1993 | Garelick | |
| 5,201,333 | A | 4/1993 | Shalmon et al. | |
| 5,261,682 | A | 11/1993 | Chuang | |
| 5,275,187 | A | 1/1994 | Davis | |
| 5,499,856 | A | 3/1996 | Sorrell et al. | |
| 5,529,425 | A | 6/1996 | Spies et al. | |
| 5,555,954 | A | 9/1996 | Swiderski | |
| 5,579,793 | A | 12/1996 | Gajewski et al. | |
| 5,605,169 | A | 2/1997 | Light | |
| 6,311,708 | B1 | 11/2001 | Howle | |
| 6,776,433 | B2 * | 8/2004 | Harrison et al. | 280/647 |
| 6,948,727 | B1 | 9/2005 | Bakken | |
| 7,306,246 | B2 | 12/2007 | Gale | |

(Continued)

FOREIGN PATENT DOCUMENTS

JP 2006043224 A * 2/2006

(Continued)

*Primary Examiner* — Winnie Yip
(74) *Attorney, Agent, or Firm* — Nilay J. Choksi; Smith & Hopen, P.A.

(57) ABSTRACT

A foldable walker includes upstanding legs arranged in a generally square pattern, each of which is capped by a fixed joint member and each of which has a slider member slideably disposed on it. Two forward legs are interconnected by two rigid links arranged in a scissors arrangement with the uppermost end of each link pivotally connected to a fixed joint member and the lowermost end of each link pivotally connected to a slider. Each forward leg is interconnected to its associated rearward leg in the same way. Each pair of rigid links is interconnected to one another by a pivot pin. The linkage enables the width and the depth of the walker to be reduced to a very small space and telescoping legs reduce the height dimension of the walker. Handles are folded when the walker is stored and pivoted into their operable position when the walker is deployed.

6 Claims, 6 Drawing Sheets

U.S. PATENT DOCUMENTS

| | | | | |
|---|---|---|---|---|
| 7,373,942 | B1 | 5/2008 | Yeager | |
| 7,472,921 | B2 * | 1/2009 | Harrison et al. | 280/647 |
| 7,942,476 | B2 * | 5/2011 | Chen | 297/42 |
| 2007/0023073 | A1 | 2/2007 | Su | |
| 2011/0030749 | A1 * | 2/2011 | Miller | 135/67 |

FOREIGN PATENT DOCUMENTS

| | | | |
|---|---|---|---|
| JP | 2008220643 | A * | 9/2008 |

* cited by examiner

FOLDABLE WALKER

CROSS REFERENCE TO RELATED APPLICATION

This application claims priority to currently pending U.S. Provisional Patent Application No. 61/227,246, entitled "FOLDABLE WALKER", filed on Jul. 21, 2009, the contents of which are hereby incorporated by reference.

BACKGROUND OF THE INVENTION

1. Field of the Invention

This invention relates, generally, to medical appliances known as walkers. More particularly, it relates to a walker that has a storage configuration that has less height, depth and width than its fully deployed configuration.

2. Description of the Prior Art

A walker is a three-sided tubular frame device having a transversely disposed front end and a pair of side frames disposed at roughly right angles to opposite ends of the front structure and in trailing relation thereto. The person using the walker stands in a space where the front end is forward of the person and the side frames are to the left and right. The top of each side frame provides a horizontal, longitudinally extending handle for grasping by the user.

The front end includes two (2) transversely spaced apart legs and each side structure includes one (1) leg that trails its associated front leg. A total of four (4) legs, roughly arranged in a square pattern, provide a stable structure upon which a person can lean or otherwise use for support when standing or walking. Walking requires that the user lift the walker and move it in the direction of walking after each step or steps. Some walkers include wheels for the front two (2) legs so that the walker can be rolled forwardly after each step.

It is a simple matter to add hinges to the opposite ends of the front structure so that the two side frames can be folded toward one another when the walker is not in use. Such folding reduces the depth of the walker but not its height or its width. Such reduction in depth is desirable because it enables a number of folded walkers to be stored in a space occupied by a single unfolded walker.

Walkers have also been developed that have telescoping or folding legs so that the height dimension of the walker can also be reduced to further optimize storage space.

However, a foldable walker that has a reduced depth, a reduced height, and a reduced width would represent an important advance in the art of foldable walkers. No such walker appears in the prior art.

The known foldable walkers cannot fit into small spaces such as airline overhead storage compartments, compact car front seats, and other such limited space environments.

Moreover, most of the known foldable walkers are mechanically complex and cause their owners to seek help when deploying them for use or folding them after use. Such dependence on others reduces the user's sense of independence and thereby is detrimental to the user's mental well-being.

Thus there is a need for a foldable walker that is foldable in all three dimensions so that it can fit into airline overhead compartments, compact car front seats and the like.

There is a need as well for a foldable walker that is mechanically simple to fold and unfold so that the user need not seek assistance from third parties when beginning or ending use of the walker.

SUMMARY OF THE INVENTION

The long-standing but heretofore unfulfilled need for a walker that is foldable in three dimensions to maximize storage space is now met by a new, useful, and non-obvious invention.

The novel walker includes first, second, third, and fourth upstanding legs arranged in a generally square pattern. The first and second upstanding legs are disposed in transversely opposed, lateral relation to one another and collectively form a front end of the walker. The first and third upstanding legs are disposed in longitudinally spaced apart relation to one another and collectively form a left side of said walker, and the second and fourth upstanding legs are disposed in longitudinally spaced apart relation to one another and collectively form a right side of the walker.

First, second, third, and fourth fixed joint members are respectively disposed in surmounting relation to the first, second, third, and fourth upstanding legs. First, second, third, and fourth slider members are respectively slideably disposed on the first, second, third, and fourth upstanding legs below the fixed joint members.

A first rigid link has a first end pivotally connected to the first fixed joint member and a second end pivotally connected to the second slider. A second rigid link has a first end pivotally connected to the second fixed joint member and a second end pivotally connected to the first slider. A third rigid link has a first end pivotally connected to the second fixed joint member and a second end pivotally connected to the first slider. A fourth rigid link has a first end pivotally connected to the first fixed joint member and a second end pivotally connected to the third slider. A fifth rigid link has a first end pivotally connected to the second fixed joint member and a second end pivotally connected to the fourth slider. A sixth rigid link has a first end pivotally connected to the fourth fixed joint member and a second end pivotally connected to the second slider.

Each rigid link of the first, second, third, fourth, fifth and sixth rigid links has a circular hub that is centrally apertured. A first pivot pin extends through the respective central apertures of the respective central hubs of the first and second rigid links and thereby pivotally interconnects the first and second rigid links. A second pivot pin extends through the respective central apertures of the respective central hubs of the third and fourth rigid links and thereby pivotally interconnects the third and fourth rigid links. A third pivot pin extends through the respective central apertures of said respective central hubs of the fifth and sixth rigid links, thereby pivotally interconnecting the fifth and sixth rigid links.

Displacing the first and second upstanding legs toward one another causes the third and fourth legs to be displaced toward one another and toward the first and second upstanding legs, respectively. Displacing the first and second upstanding legs away from one another causes the third and fourth legs to be displaced away from one another and away from the first and second upstanding legs, respectively.

A first handle has a first end pivotally connected to the third fixed joint member and has a stored configuration where it is substantially vertically disposed, parallel to the third upstanding leg and disposed in abutting relation thereto. The first handle has an elongate extent substantially equal to the longitudinal spacing between said first and third fixed joint members and has a fully deployed configuration where it is substantially horizontally disposed. The first handle has a second end that releasably engages the first fixed joint member when fully deployed.

A second handle has a first end pivotally connected to the fourth fixed joint member and has a stored configuration where it is substantially vertically disposed, parallel to the fourth upstanding leg and disposed in abutting relation thereto. The second handle has an elongate extent substantially equal to the longitudinal spacing between the second and fourth fixed joint members and has a fully deployed configuration where it is substantially horizontally disposed. The second handle has a second end that releasably engages the second fixed joint member when fully deployed.

Each of the upstanding legs has a cylindrical shape and each of the fixed joint members has a downwardly opening blind cylindrical bore formed therein to securely receive an uppermost end of a respective upstanding leg therein.

The first and second fixed joint members have a base formed by four flat sides and a square configuration when viewed in plan. Both of the first and second fixed joint members also have a pair of transversely spaced apart lugs formed integrally with their respective bases and the lugs projecting upwardly from their respective bases.

The second end of the first handle is flat and is disposed between the pair of transversely spaced apart lugs formed integrally with the first fixed joint member when the first handle is fully deployed and the second end of the second handle is flat and is disposed between the pair of transversely spaced apart lugs formed integrally with the second fixed joint member when the second handle is fully deployed.

The third and fourth fixed joint members also have a base formed by four flat sides and a square configuration when viewed in plan. Both of the third and fourth fixed joint members have a pair of transversely spaced apart lugs formed integrally with their respective bases and the lugs extend longitudinally in trailing relation to their respective bases.

The first end of the first handle is flat and is disposed between the pair of transversely spaced apart, longitudinally extending lugs. It is permanently pivotally connected to said pair of transversely spaced apart, transversely extending lugs. The first end of the second handle is also flat and is permanently disposed between the pair of transversely spaced apart, longitudinally extending lugs formed integrally with the second fixed joint member when the second handle is fully deployed.

The primary object of this invention is to provide a walker that can be folded into a very small space.

A closely related object is to provide a walker that can be reduced in height, depth, and width.

Another object is to accomplish the foregoing object in a mechanically elegant way so that a walker user need not seek third party assistance when deploying or folding the walker.

These and other important objects, advantages, and features of the invention will become clear as this description proceeds.

The invention accordingly comprises the features of construction, combination of elements, and arrangement of parts that will be exemplified in the description set forth hereinafter and the scope of the invention will be indicated in the claims.

BRIEF DESCRIPTION OF THE DRAWINGS

For a fuller understanding of the nature and objects of the invention, reference should be made to the following detailed description, taken in connection with the accompanying drawings, in which.

DETAILED DESCRIPTION OF THE PREFERRED EMBODIMENT

Figure 1:
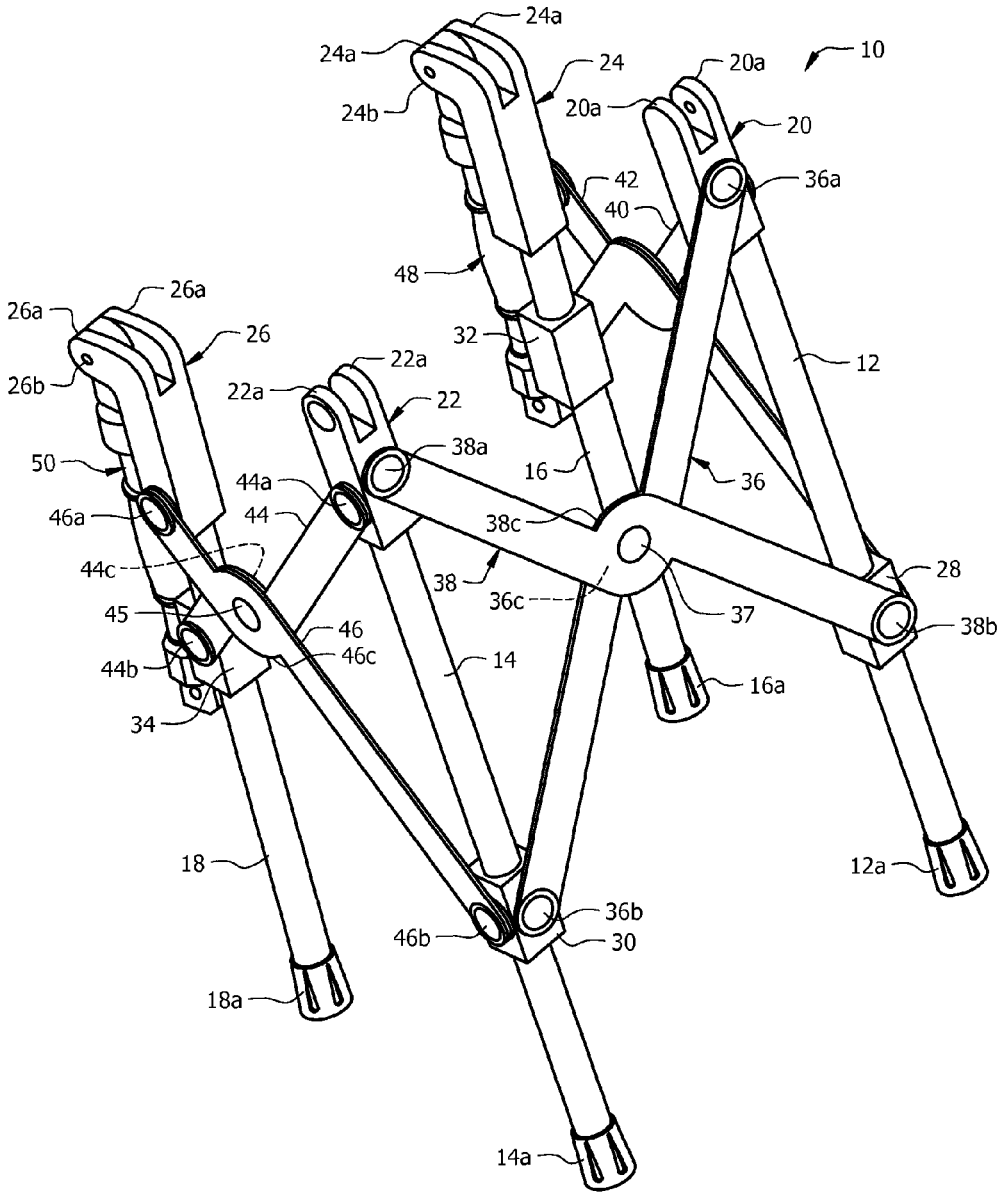
FIG. 1 is a front perspective view of the novel walker in a partially deployed and partially folded configuration.

Referring now to FIG. 1, it will there be seen that the novel walker is denoted as a whole by the reference numeral 10. In FIG. 1, the telescoping legs are fully retracted so walker 10 is in its shortest configuration. However, walker 10 is depicted in a partially but not quite fully open configuration both in the width and depth dimensions.

Novel walker 10 includes four upstanding cylindrical legs denoted 12, 14, 16, and 18. Each is respectively capped at its bottom by conventional protective covers 12*a*, 14*a*, 16*a*, and 18*a* that form no part of the invention per se. Conventional rollers could also be provided in a well-known way.

Forward legs 12 and 14 are transversely opposed to one another when the walker is fully deployed and oriented in a forward direction of travel, i.e., said legs are in lateral relation to one another when the walker is so deployed and oriented. Legs 12 and 14 collectively form the front end of the walker. Rearward legs 16 and 18 are also transversely opposed to one another when the walker is fully deployed and oriented in a forward direction of travel, i.e., said rearward legs are in lateral relation to one another when the walker is so deployed and oriented. Legs 12 and 16 are longitudinally spaced apart from one another and collectively form the left side of the walker. Legs 14 and 18 are longitudinally spaced apart from one another and collectively form the right side thereof.

First fixed joint member 20 surmounts first leg 12. It has a downwardly opening blind cylindrical bore formed therein to slidingly and securely receive the uppermost end of leg 12 therewithin. Fixed joint member 20 has a base formed by four flat sides and therefore has a generally square configuration when seen in plan view. It includes a pair of transversely opposed lugs, collectively denoted 20*a*, that project upwardly from the base, each of which is centrally apertured as depicted.

Opposite ends of a connecting pin are disposed within the apertures. The connecting pin is spring-loaded so that it may be released by squeezing its opposite ends toward one another, i.e., such squeezing causes retraction of the opposite ends from the apertures so that an item held by such pin is released and can be removed from the space between said lugs. The opposite ends of the pin are rounded so that said pins momentarily retract when an item to be locked into the space between the lugs is inserted into the space. The self-bias then causes the opposite ends of the pin to extend into the apertures to lock the item into place until the opposite ends of the pin are manually squeezed as aforesaid.

Second fixed joint member 22 surmounts second leg 14. It has a downwardly opening blind cylindrical bore formed therein to slidingly receive the uppermost end of leg 14 therewithin. Fixed joint member 22 has a base having four flat sides and therefore has a generally square configuration when seen in plan view. It includes a pair of transversely opposed lugs, collectively denoted 22*a*, that project upwardly from said base. Each lug is centrally apertured as depicted so that a spring-loaded connecting pin, mentioned above, may be extended therebetween.

First and second fixed joint members 20 and 22 have a common length as depicted.

Third fixed joint member 24 surmounts third leg 16. It has a downwardly opening blind cylindrical bore formed therein to slidingly receive the uppermost end of leg 16 therewithin. Fixed joint member 24 has a base including four flat sides. It includes a pair of transversely opposed, longitudinally-extending lugs, collectively denoted 24*a*, that extend in trailing relation from said four-sided base. Each lug is centrally apertured near its trailing end as depicted to receive opposite ends of solid connecting pin 24*b*, said opposite ends being press fit into their respective openings so that pin 24*b* is permanently installed as depicted in FIG. 1. The opposite ends of pin 24*b* are flat and flush with the respective outer surfaces of lugs 24*a*. Handle 48, disclosed hereinafter, is pivotally connected to pin 24*b* and is free to rotate about said pin as disclosed hereinafter in connection with said handle 48. Fixed joint member 24 has the appearance of an inverted "L" when viewed in side elevation.

Fourth fixed joint member 26 surmounts fourth leg 18. It has a downwardly opening blind cylindrical bore formed therein to slidingly receive the uppermost end of leg 18 therewithin. Fixed joint member 26 has a base including four flat sides. It further includes a pair of transversely opposed, longitudinally-extending lugs, collectively denoted 26*a*, each of which is centrally apertured near its trailing end as depicted to receive opposite ends of solid connecting pin 26*b*, said opposite ends being press fit into their respective openings so that pin 26*b* is permanently installed as depicted in FIG. 1. The opposite ends of pin 26*b* are flat and flush with the respective outer surfaces of lugs 26*a*. Handle 50, disclosed hereinafter, is pivotally connected to pin 26*b* and is free to rotate about said pin as disclosed hereinafter in connection with said handle 50. Fixed joint member 26 has the appearance of an inverted "L" when viewed in side elevation.

Third and fourth fixed joint members 24 and 26 have a common length as depicted. The common length of fixed joint members 24, 26 exceeds the common length of fixed joint members 20, 22.

First slider 28 slideably engages first leg 12 and has four flat sides sharing a common size and said slider has a square configuration when viewed in plan. A central bore is formed therein for sliding reception of first leg 12. Second, third, and fourth sliders 30, 32, and 34 have the same structure and are respectively slidingly received on second, third, and fourth legs 14, 16, and 18, respectively.

First rigid link 36 has a first end pivotally connected to first fixed joint member 20 at pivot point 36*a* and has a second end pivotally connected to second slider 30 at pivot point 36*b*. Rigid link 36 has a circular central hub 36*c* that is centrally apertured to receive pivot pin 37.

Second rigid link 38 has a first end pivotally connected to second fixed joint member 22 at pivot point 38*a* and has a second end pivotally connected to first slider 28 at pivot point 38*b*. Second rigid link 38 has a circular central hub 38*c* that is centrally apertured to receive pivot pin 37.

Circular central hub 36*c* of link 36 underlies circular central hub 38*c* in FIG. 1 as indicated by the dotted lead line associated with said circular central hub 36*c*. Pivot pin 37 is common to links 36, 38 and said links rotate about said pivot pin in a scissors-like action as legs 12 and 14 are brought closer to one another when walker 10 is being folded from a deployed configuration and said links rotate about said pivot pin as legs 12 and 14 are separated from one another when walker 10 is being deployed from a folded configuration. Sliders 28 and 30 slide downwardly relative to their respective legs during a folding action and they slide upwardly when walker 10 is being deployed for use.

Third rigid link 40 has a first end pivotally connected as at 40*a* to a flat outer side wall of first fixed joint member 20 and has a second end pivotally connected as at 40*b* to a flat outer sidewall of third slider 32. Third rigid link 40 has a circular central hub 40*c* that is centrally apertured to receive a pivot pin like pivot pin 37 but the central hub and pivot pin are not numbered in FIG. 1 to avoid cluttering the drawing. The respective pivot points 40*a* and 40*b* and central hub 40*c* are obscured in FIG. 1 but share the same structure as pivot points 36*a*, 36*b* and central hub 36*c*.

Fourth rigid link 42 has a first end pivotally connected as at 42*a* to a flat outer sidewall of third fixed joint member 24 and has a second end pivotally connected as at 42*b* to a flat outer sidewall of first slider 28. Fourth rigid link 42 has a circular central hub 42*c* that is centrally apertured to receive a pivot pin like pivot pin 37. The respective pivot points 42*a* and 42*b* and central hub 42*c* are not numbered in FIG. 1 to avoid cluttering the drawing.

The circular central hub of link 42 underlies the circular central hub of link 40 as depicted in FIG. 1. A pivot pin 41 like pivot pin 37 is common to links 40 and 42 and said links rotate about said pivot pin as legs 12 and 16 are brought closer to one another when walker 10 is being folded from a deployed configuration and said links rotate about said pivot pin as legs 12 and 16 are separated from one another when walker 10 is being deployed from a folded configuration. Sliders 28 and 32 slide downwardly relative to their respective legs during a folding action and they slide upwardly when walker 10 is being deployed for use.

Fifth rigid link 44 has a first end pivotally mounted as at 44*a* to a flat outer side wall of second fixed joint member 22 and has a second end pivotally connected to a flat outer sidewall of fourth slider 34 as at 44*b*. Fifth rigid link 44 has a circular central hub 44*c* having a dotted lead line because it is obscured in FIG. 1. Central hub 44*c* is centrally apertured to receive pivot pin 45.

Sixth rigid link 46 has a first end pivotally mounted to a flat outer sidewall of fourth fixed joint member 26 as at 46*a* and has a second end pivotally connected as at 46*b* to a flat outer sidewall of second slider 30. Sixth rigid link 46 has circular central hub 46*c* that is centrally apertured to receive pivot pin 45.

The circular central hub 44*c* of link 44 underlies circular central hub 46*c* of link 46 as depicted in FIG. 1. Pivot pin 45 is common to links 44 and 46 and said links rotate about said pivot pin as legs 14 and 18 are brought closer to one another when walker 10 is being folded from a deployed configuration and said links rotate about said pivot pin as legs 14 and 18 are separated from one another when walker 10 is being deployed from a folded configuration. Sliders 30 and 34 slide downwardly relative to their respective legs during a folding action and they slide upwardly when walker 10 is being deployed for use.

Handles 48 and 50 are depicted in their folded, undeployed configuration in FIG. 1. When so folded, they lie parallel to legs 16 and 18, respectively, in abutting relation thereto.

A first end of handle 48 is flat and pivotally connected to fixed joint member 24 between longitudinally-extending lugs 24*a*, 24*a* by permanent pivot pin 24*b* disclosed in detail above so that a second flat end of said handle can be releasably inserted between lugs 20*a*, 20*a* of fixed joint member 20. When so inserted, spring-loaded pin 20*b* releasably secures said second flat end between said lugs. Spring-loaded pin 20*b* has rounded opposite ends that protrude from the respective outer surfaces of lugs 20*a*, 20*a* so that a user may compress said pin to release handle 48 when said handle is to be returned to its storage configuration.

A first end of handle 50 is flat and pivotally connected to fixed joint member 26 between lugs 26*a*, 26*a* by permanent pivot pin 26*b* disclosed in detail above so that a second flat end of said handle can be inserted between lugs 22*a*, 22*a* of fixed joint member 22. When so inserted, spring-loaded pin 22*b* releasably secures said second flat end between said lugs. Spring-loaded pin 22*b* has rounded opposite ends that protrude from the respective outer surfaces of lugs 22*a*, 22*a* so that a user may compress said pin to release handle 50 when said handle is to be returned to its storage configuration.

Figure 2:
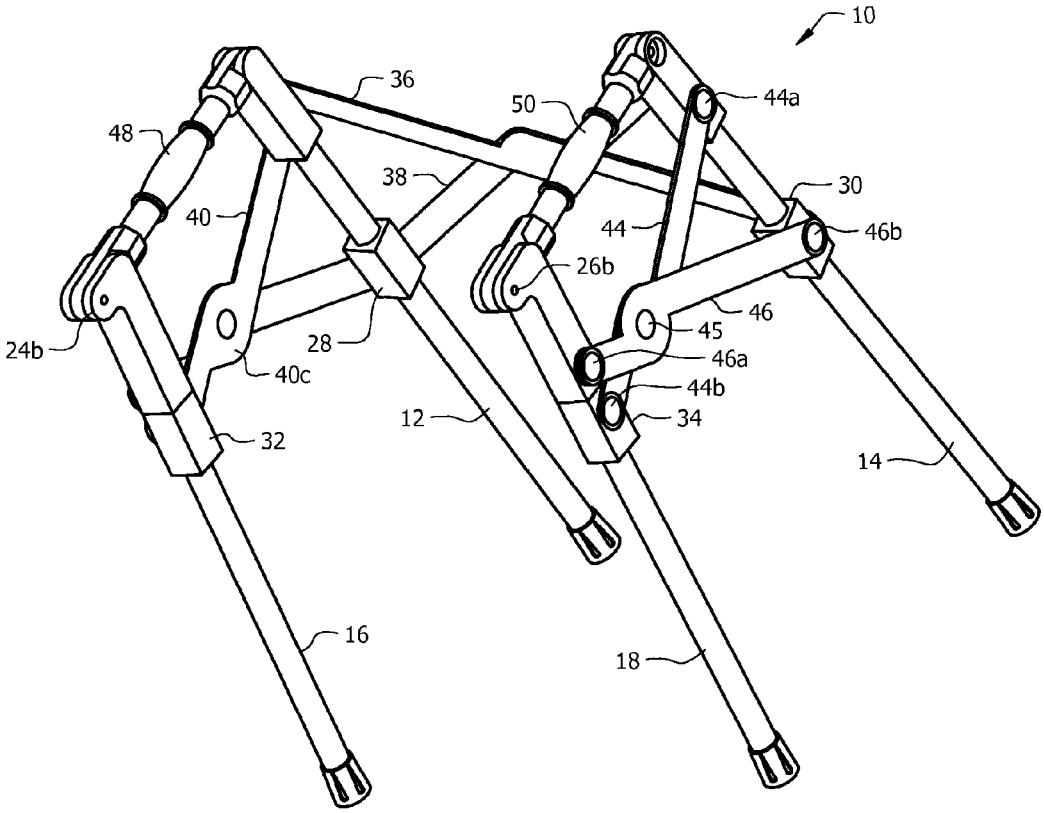
FIG. 2 is a rear perspective view of the walker when opened to its full width and depth but not its full height.

FIG. 2 depicts handles 48 and 50 when operatively deployed. Walker 10 is therefore at its maximum depth. It is also locked into its maximum width but it is not at its maximum height because the telescoping legs are retracted.

Figure 3:
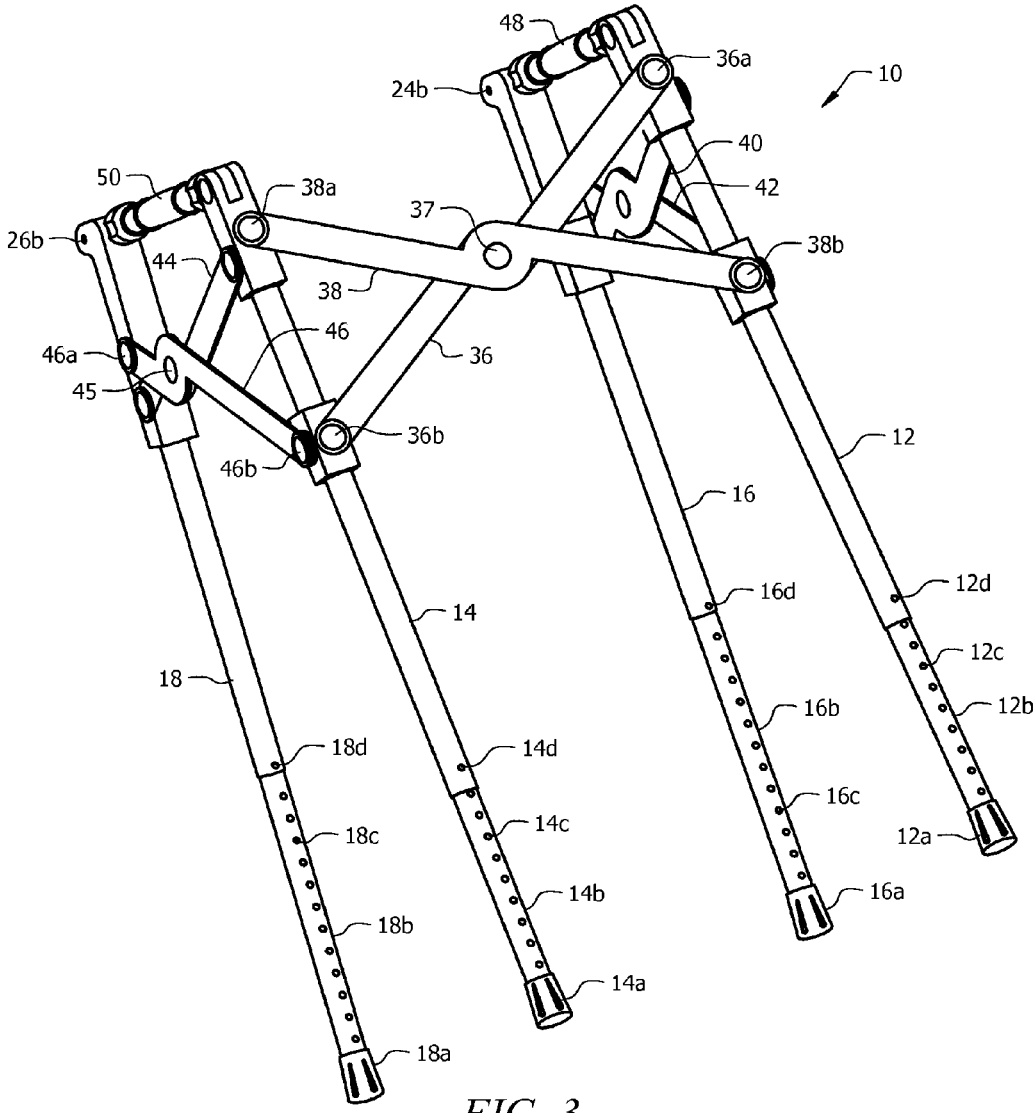
FIG. 3 is a front perspective view when the walker is fully deployed.

FIG. 3 depicts the legs in their respective fully extended configurations and the walker is thus in its fully deployed configuration. Of course, the amount of leg extension depends upon the height of the user. Tubes 12*b*, 14*b*, 16*b*, and 18*b* are slideably received within the hollow interiors of legs 12, 14, 16, and 18 in a well-known way and said tubes are provided with equidistantly spaced apart apertures 12*c*, 14*c*, 16*c*, and 18*c* along their respective extents to accommodate spring-loaded locking pins 12*d*, 14*d*, 16*d*, and 18*d* having rounded opposite ends that protrude so that the height of walker 10 can be adjusted by momentarily compressing said locking pins in a well-known way.

Figure 4:
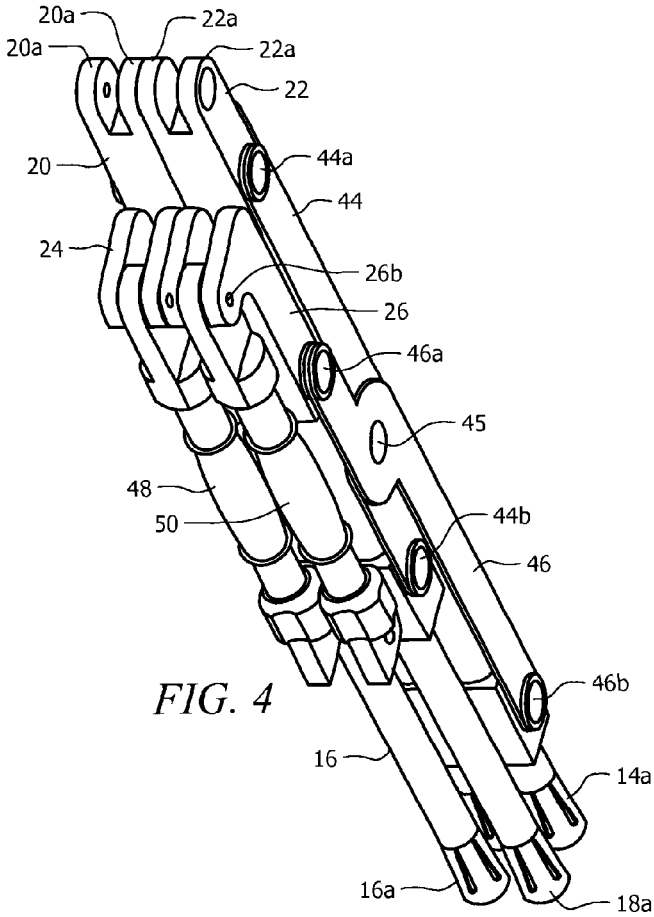
FIG. 4 is a rear perspective view of the walker when fully folded.
Figure 5:
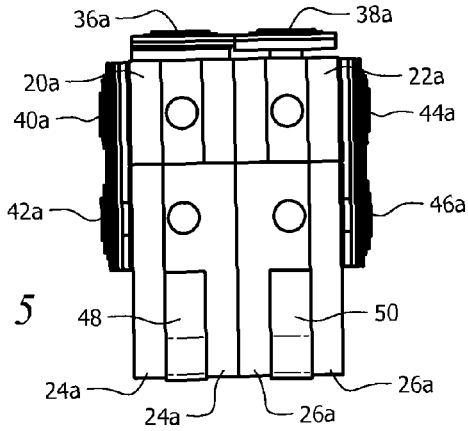
FIG. 5 is a top plan view of the walker when fully folded.
Figure 6:
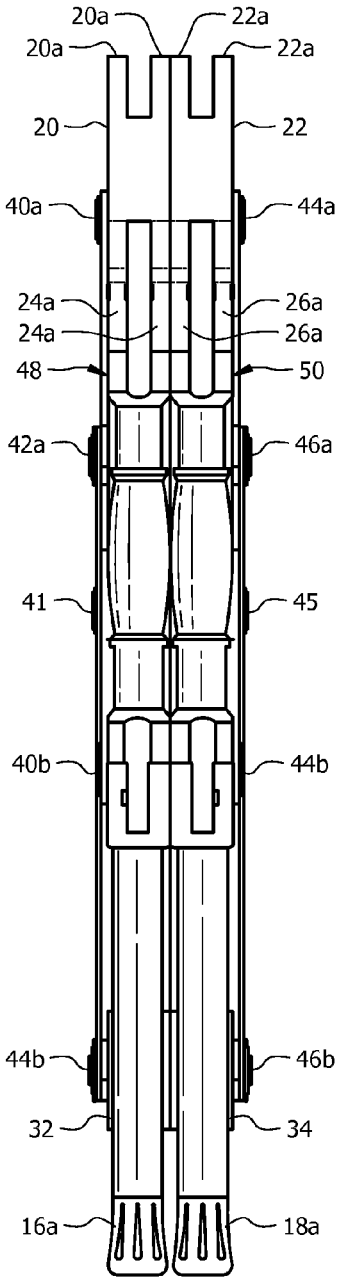
FIG. 6 is a rear elevational view of the walker when fully folded.
Figure 7:
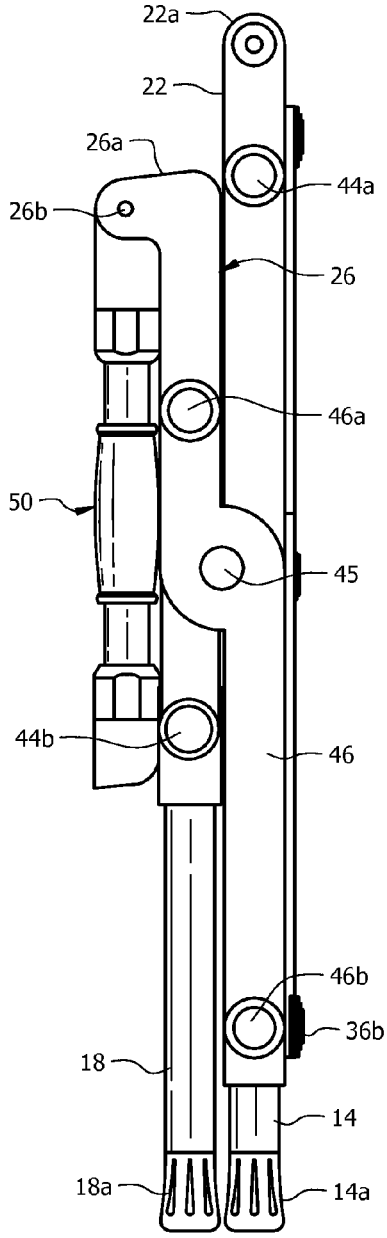
FIG. 7 is a right side elevational view of the walker when fully folded.
Figure 8:
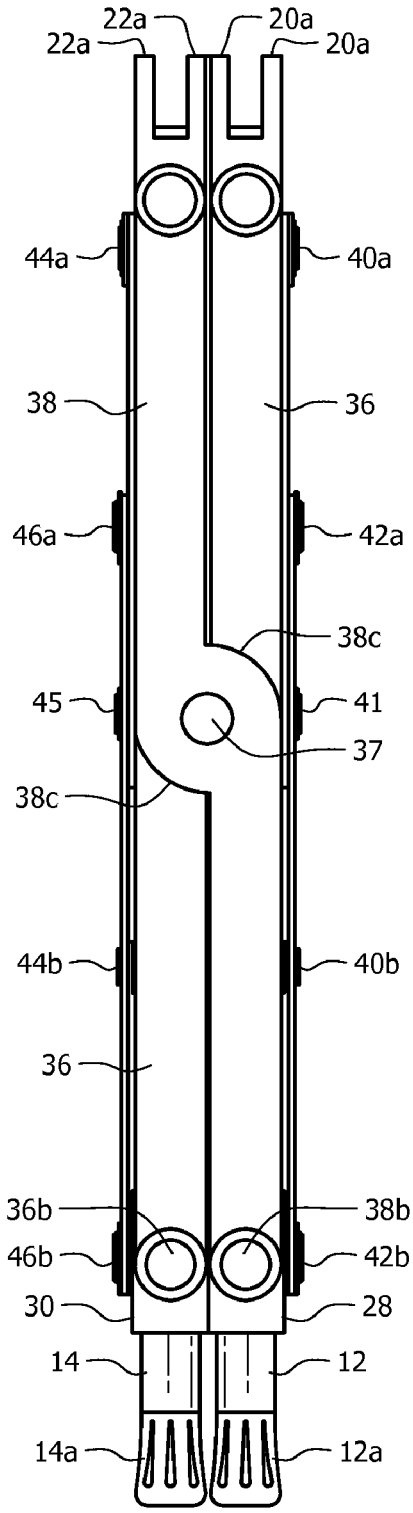
FIG. 8 is a front elevational view of the walker when fully folded.

Now that walker 10 has been depicted in partially and fully deployed configurations, the various views that depict it in its fully folded configuration will be more easily understood. FIG. 4 is a rear perspective view of the fully folded walker and FIG. 5 is a top plan view thereof. FIGS. 6, 7, and 8 are rear elevational, right side elevational, and front elevational views respectively. The various pivot points obscured in FIGS. 1-3 are not obscured in FIGS. 4-8.

It should also be understood that the four (4) legs are parallel to one another when the walker is totally folded, but they are oblique to one another when the walker is deployed, i.e., the legs are slightly further apart at their lowermost ends relative to their uppermost ends as is clear from the drawings. This stabilizes the walker in the two (2) directions of front-rear and left-right.

Deploying the novel walker from its fully folded configuration merely requires grasping any two of the legs and pulling them apart from one another. The elegant scissors-like linkage ties all of the legs together so that when two contiguous legs are pulled apart, all four of them diverge from one another. Handles 48 and 50 are easily rotated into position to lock the walker frame into a stable, safe configuration, there being no need to squeeze any connecting pins to accomplish said deployment of the handles. The legs are then extended to the desired length, again in the absence of any need to squeeze any pins. A pin associated with each leg and handle is squeezed to release those items when the walker is returned to its folded configuration. When the handles are pivoted back to their respective storage configurations, pushing any two contiguous legs toward one another will return all four legs to their storage configuration. When all four legs are totally closed, pins 12*d*, 14*d*, 16*d*, and 18*d* are pressed momentarily to allow retraction of the extended legs as aforesaid.

It will thus be seen that the objects set forth above, and those made apparent from the foregoing description, are efficiently attained and since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention that, as a matter of language, might be said to fall therebetween.

What is claimed is:

1. A foldable walker, comprising:

first, second, third, and fourth upstanding legs arranged in a generally square pattern;

said first and second upstanding legs disposed in transversely opposed, lateral relation to one another and collectively forming a front end of said walker;

said first and third upstanding legs disposed in longitudinally spaced apart relation to one another and collectively forming a left side of said walker;

said second and fourth upstanding legs disposed in longitudinally spaced apart relation to one another and collectively forming a right side of said walker;

first, second, third, and fourth fixed joint member respectively disposed in surmounting relation to said first, second, third, and fourth upstanding legs;

first, second, third, and fourth slider members respectively slideably disposed on said first, second, third, and fourth upstanding legs below said fixed joint members;

a first rigid link having a first end pivotally connected to said first fixed joint member and having a second end pivotally connected to said second slider, said first rigid link having a circular central hub that is centrally apertured;

a second rigid link having a first end pivotally connected to said second fixed joint member and having a second end pivotally connected to said first slider, said second rigid link having a circular central hub that is centrally apertured;

a first pivot pin extending through the respective central apertures of said respective circular central hubs of said first and second rigid links, said first pivot pin thereby pivotally interconnecting said first and second rigid links;

a third rigid link having a first end pivotally connected to said second fixed joint member and having a second end pivotally connected to said first slider, said third rigid link having a circular central hub that is centrally apertured;

a fourth rigid link having a first end pivotally connected to said first fixed joint member and having a second end pivotally connected to said third slider, said fourth rigid link having a circular central hub that is centrally apertured;

a second pivot pin extending through the respective central apertures of said respective circular central hubs of said third and fourth rigid links, said second pivot pin thereby pivotally interconnecting said third and fourth rigid links;

a fifth rigid link having a first end pivotally connected to said second fixed joint member and having a second end pivotally connected to said fourth slider, said fifth rigid link having a circular central hub that is centrally apertured; and a sixth rigid link having a first end pivotally connected to said fourth fixed joint member and having a second end pivotally connected to said second slider, said sixth rigid link having a circular central hub that is centrally apertured;

a third pivot pin extending through the respective central apertures of said respective circular central hubs of said fifth and sixth rigid links, said third pivot pin thereby pivotally interconnecting said fifth and sixth rigid links;

whereby displacing said first and second upstanding legs toward one another causes said third and fourth legs to be displaced toward one another and toward said first and second upstanding legs, respectively;

whereby displacing said first and second upstanding legs away from one another causes said third and fourth legs to be displaced away from one another and away from said first and second upstanding legs, respectively; and a first handle having a first end pivotally connected to said third fixed joint member;

said first handle having a stored configuration where it is substantially vertically disposed, parallel to said third upstanding leg and disposed in abutting relation thereto;

said first handle having an elongate extent substantially equal to the longitudinal spacing between said first and third fixed joint members;

said first handle having a fully deployed configuration where it is substantially horizontally disposed;

said first handle having a second end that engages said first fixed joint member when fully deployed.

2. The walker of claim 1, further comprising:

a second handle having a first end pivotally connected to said fourth fixed joint member;

said second handle having a stored configuration where it is substantially vertically disposed, parallel to said fourth upstanding leg and disposed in abutting relation thereto;

said second handle having an elongate extent substantially equal to the longitudinal spacing between said second and fourth fixed joint members;

said second handle having a fully deployed configuration where it is substantially horizontally disposed;

said second handle having a second end that engages said second fixed joint member when fully deployed.

3. The walker of claim 2, further comprising:

each of said upstanding legs having a cylindrical shape and each of said fixed joint members having a downwardly opening blind cylindrical bore formed therein to securely receive an uppermost end of a respective upstanding leg therein.

4. The walker of claim 3, further comprising:

said first and second fixed joint members having a base formed by four flat sides and a square configuration when viewed in plan;

both of said first and second fixed joint members having a pair of transversely spaced apart lugs formed integrally with said respective bases and projecting upwardly therefrom;

said second end of said first handle being flat and being disposed between said pair of transversely spaced apart lugs formed integrally with said first fixed joint member when said first handle is fully deployed; and said second end of said second handle being flat and being disposed between said pair of transversely spaced apart lugs formed integrally with said second fixed joint member when said second handle is fully deployed.

5. The walker of claim 4, further comprising:

said third and fourth fixed joint members having a base formed by four flat sides and a square configuration when viewed in plan;

both of said third and fourth fixed joint members having a pair of transversely spaced apart lugs formed integrally with said respective bases and extending longitudinally in trailing relation thereto;

said first end of said first handle being flat and being disposed between said pair of transversely spaced apart, longitudinally extending lugs and being permanently pivotally connected to said pair of transversely spaced apart, transversely extending lugs; and said first end of said second handle being flat and being disposed between said pair of transversely spaced apart, longitudinally extending lugs formed integrally with said second fixed joint member when said second handle is fully deployed.

6. The walker of claim 1, further comprising:

first, second, third, and fourth extension tubes slideably received within said first, second, third, and fourth upstanding legs, respectively.

* * * * *